US007096636B1

(12) United States Patent
Neill et al.

(10) Patent No.: US 7,096,636 B1
(45) Date of Patent: Aug. 29, 2006

(54) MODULAR BUILDING BLOCK SYSTEM

(75) Inventors: Jeremiah F. Neill, 717 S. U.S. Hwy. 1 #906, Jupiter, FL (US) 33477; Matthew F. Neill, 717 S. U.S. Hwy. 1 #906, Jupiter, FL (US) 33477

(73) Assignees: Jeremiah F. Neill, Jupiter, FL (US); Matthew F. Neill, Jupiter, FL (US)

( * ) Notice: Subject to any disclaimer, the term of this patent is extended or adjusted under 35 U.S.C. 154(b) by 0 days.

(21) Appl. No.: 10/300,067

(22) Filed: Nov. 20, 2002

Related U.S. Application Data

(60) Provisional application No. 60/333,808, filed on Nov. 20, 2001.

(51) Int. Cl.
*E04C 2/04* (2006.01)
*E04B 5/04* (2006.01)

(52) U.S. Cl. ..... 52/605; 52/592.3; 52/438; 52/591.1

(58) Field of Classification Search ..... 52/605, 52/604, 606, 286, 592.5, 592.3, 590.3, 570, 52/316, 591.1, 589.1
See application file for complete search history.

(56) References Cited

U.S. PATENT DOCUMENTS 2,498,276 A * 2/1950 Kany ..... 52/438
2,634,602 A * 4/1953 Zagray ..... 52/436
2,655,032 A * 10/1953 Zagray ..... 52/591.1
2,749,739 A * 6/1956 Zagray ..... 52/286
3,256,657 A * 6/1966 Phipps ..... 52/223.7
3,391,824 A * 7/1968 Wiseman ..... 206/504
3,422,588 A * 1/1969 Stewart ..... 52/436
3,968,615 A * 7/1976 Ivany ..... 52/439
4,295,313 A * 10/1981 Rassias ..... 52/438
4,306,373 A * 12/1981 Chatani et al. ..... 446/121
4,426,815 A * 1/1984 Brown ..... 52/100
4,485,604 A * 12/1984 Palamara et al. ..... 52/436
5,729,943 A * 3/1998 Cambiuzzi ..... 52/438
6,082,067 A * 7/2000 Bott ..... 52/592.3
6,506,091 B1 * 1/2003 Garpow ..... 446/75
6,539,682 B1 * 4/2003 Ryder ..... 52/437

* cited by examiner

*Primary Examiner*—Anita M. King
(74) *Attorney, Agent, or Firm*—Bromberg & Sunstein LLP

(57) ABSTRACT

A modular building system formed of blocks supported around a loadbearing pipe frame. The blocks include half cylinder protruding portions located at opposing ends of the blocks wherein the protruding portions of adjacent blocks form cylindrical fastener portions. Horizontally adjacent blocks form courses, and horizontal courses of blocks are stacked to form walls. The fastener formed by the protruding portions of a lower course extend through an aperture in the lower portion of blocks forming an upper course, and a retainer member is engaged with the fastener formed by the protruding portions to thereby lock an upper course block to two lower adjacent blocks. The retainer member is formed with a through hole for receiving a vertical pipe member in sliding engagement wherein the vertical pipe members carry vertical loads without substantially transmitting vertical loads to the blocks.

13 Claims, 21 Drawing Sheets

Section A-A

Section A-A

MODULAR BUILDING BLOCK SYSTEM

The present application claims priority from U.S. Provisional Application, Ser. No. 60/333,808, filed Nov. 20, 2001, and incorporated herein by reference.

FIELD OF THE INVENTION

This invention relates generally to a system for building walls and the like using blocks and, more particularly, to a building system using blocks formed of a plastic material which are interconnected and which cooperate with a load-bearing structure.

BACKGROUND OF THE INVENTION

Conventional concrete block construction uses rectangular blocks which are layered in courses and supported on a concrete foundation. Great care and skill is required to achieve level courses and to form truly vertical walls, resulting in high labor costs.

Numerous attempts have been made to provide a building block construction which may be assembled by unskilled labor. Such systems typically include a design which insures uniformity of construction as the blocks are assembled, such as mating protrusions and indentations, or holes which are formed in the blocks and aligned between adjacent blocks, such as by the use of pins or rods.

Although prior designs have experienced a certain degree of success, they have typically relied on the blocks as a structural component for carrying vertical loads in a structure formed by the blocks. The requirement to carry vertical loads has resulted in the blocks requiring additional material for withstanding the stresses of the loads, and thus have increased the costs of the blocks. In addition, materials such as plastic are known to flex and/or crack over time when exposed to stress, such that there is a need for a structural construction system incorporating blocks formed of plastics material, but which isolates stresses from the blocks while providing a reliably strong structure.

SUMMARY OF THE INVENTION

The present invention provides a modular building system formed of blocks which are positioned over a tubular metal load-bearing frame. The blocks are configured to form walls for a building structure while the frame is provided for bearing vertical loads of the structure.

The blocks are formed with opposing generally flat first and second side walls, defining opposing vertical surfaces of blocks. Generally, planar upper and lower portions extend between the upper and lower edges, respectively, of the first and second side walls, and a pair of end portions are located at the longitudinal ends of the first and second side walls and extend between the upper and lower portions. In addition, the upper portion of each block includes a protruding portion comprising a section of a cylinder adjacent to each of the end portions. The protruding portions comprise a half cylinder defining a half fastener and including a thread portion for engaging the thread of a cooperating retainer member.

In an assembly utilizing the blocks, the blocks are located adjacent to each other, in end-to-end relationship, to form courses of blocks, and the courses of blocks are layered upon each other. Protruding portions of the adjacent blocks form cylindrical fastener portions for engaging with the threaded retainer member. Each block is formed with an aperture through the lower portion intermediate the end portions of the block for receiving the cylindrical fastener portion formed by the two adjacent half-cylinder protruding portions. The retainer member is engaged with the cylindrical fastener formed by the protruding portions by inserting the retainer member through an upper portion of an upper block, and engagement of the retainer member with the cylindrical fastener acts to hold the upper block in engagement with the underlying two adjacent blocks.

The structure further includes frame members in the form of tubular metal elements, such as pipes, which extend through the protruding portions and through the retainer members to carry vertical loads for the structure. In a typical construction, the vertical frame members are rigidly engaged with the foundation for the structure and extend upwardly through the blocks to engagement with horizontally extending header frame members whereby the vertical loads imposed upon the structure are substantially carried by the frame members extending through the blocks.

The blocks are preferably formed from a molded plastic material and are provided with cavities adjacent at least one of the first and second side walls, and preferably both walls, for receiving an insulating material. Further, the blocks are formed with horizontal and vertical passages for accommodating utilities, such as electrical wiring and water pipes, as well as for permitting air flow, such as passive heating and cooling, through the blocks.

Other objects and advantages of the invention will be apparent from the following description, the accompanying drawings and the appended claims.

DETAILED DESCRIPTION OF THE PREFERRED EMBODIMENT

Figure 1:
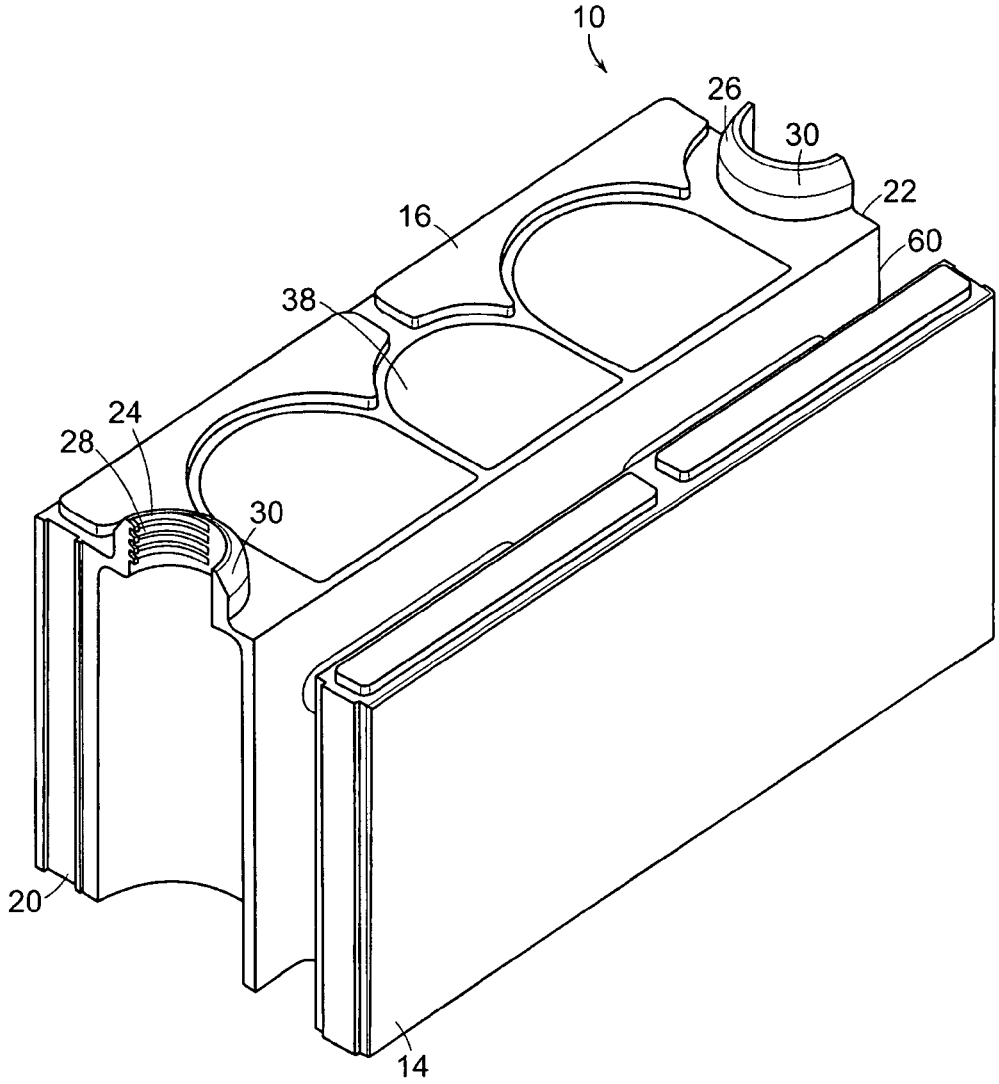
FIG. 1 is a perspective view of a block for use in the modular block system of the present invention.

Referring initially to FIGS. 1–10, the present invention comprises a modular block system for forming building structures, such as walls, and using modular blocks 10. The typical modular block 10 has a length dimension which is longer than its height dimension and its width or front to rear dimension. Further, as described in detail below, a plurality of modular blocks 10 are configured to be used together in interlocking relationship designed to hold the blocks together and to prevent air infiltration between opposing side walls of the block.

Each block includes a first generally flat side wall 12 and a second opposing generally flat side wall 14, a generally planar upper portion 16, a generally planar lower portion 18, and a pair of opposing end portions 20, 22 extending between the first and second walls 12, 14 and between the upper and lower portions 16, 18.

A pair of protruding portions 24, 26 extend upwardly from the upper portion 16 and are located adjacent each of the end portions 20, 22. Each of the protruding portions comprises a section of a cylinder, and preferably comprises a half cylinder defining a half fastener. Further, each of the protruding portions 24, 26, includes a thread portion 28 located interiorly of each protruding portion 24, 26. In the present embodiment, the thread portion 28 extends around only a portion of the circumference of the protruding portion, and preferably extends around half of each of the protruding portion 24, 26 to define a 45° circumferential sector of thread within each protruding portion 24, 26.

Each protruding portion 24, 26 further includes an angled or tapered outer edge 30. When two blocks 10 are positioned adjacent each other, the protruding portion 24 of one block 10 is positioned adjacent the protruding portion 26 of the adjacent block 10 whereby the protruding portions form a circular or cylindrical fastener, and the tapered upper edges 30 form an upwardly facing conical end portion.

The lower portion 18 of the block 10 defines an aperture 32 located generally centrally between the end portions 20, 22 and aligned in a vertical plane passing through and bisecting the protruding portions 24, 26. The aperture 32 includes an aperture wall 34 substantially matching the angle of the tapered edge 30 of the protruding portions 24, 26.

Referring additionally to FIGS. 11–17, a wall for a building structure is shown constructed using a plurality of the blocks 10. As can be seen, the blocks 10 are engaged in side by side relationship to form horizontal courses, and a plurality of courses are layered upon each other in staggered relationship.

Figure 12:
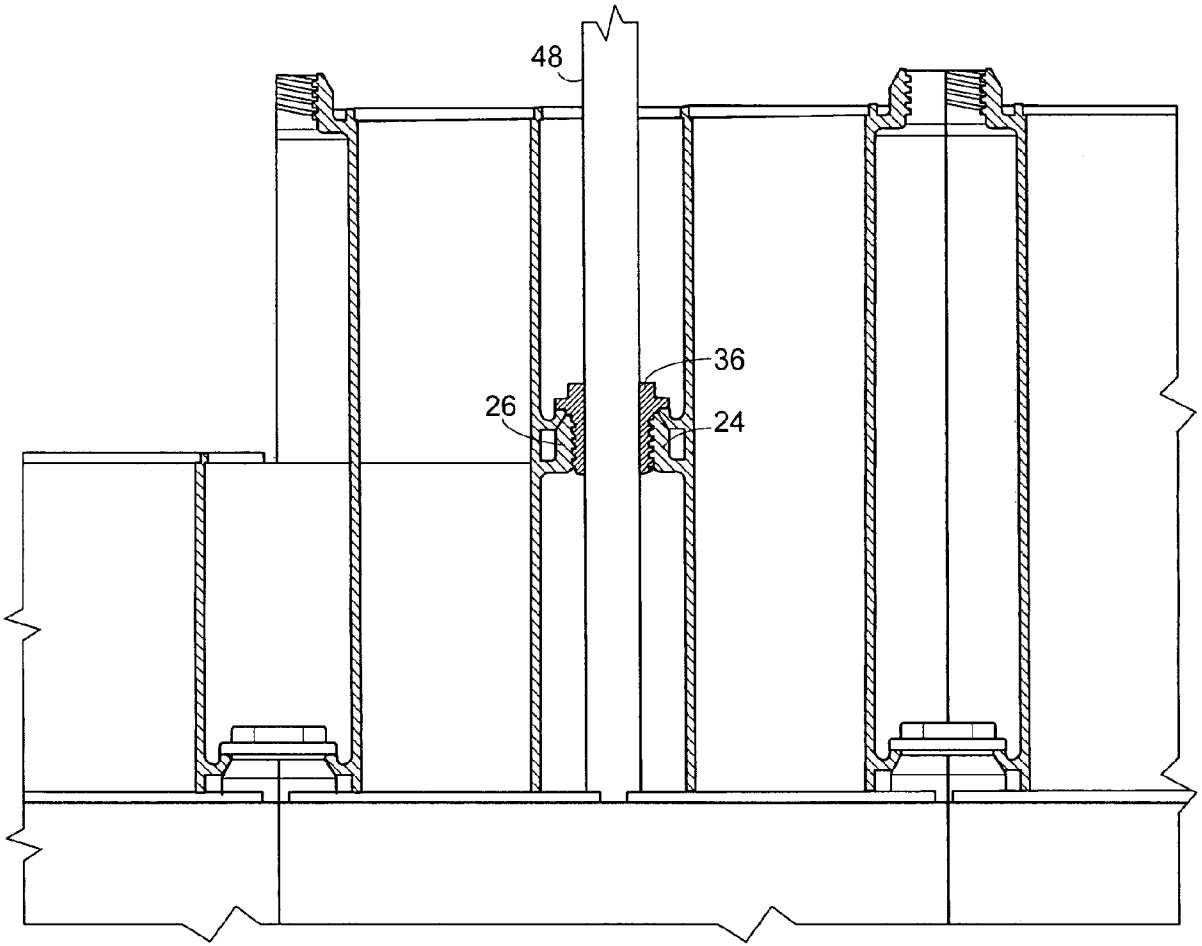
FIG. 12 is partial cross-sectional view taken through the wall of FIG. 11.
Figure 13:
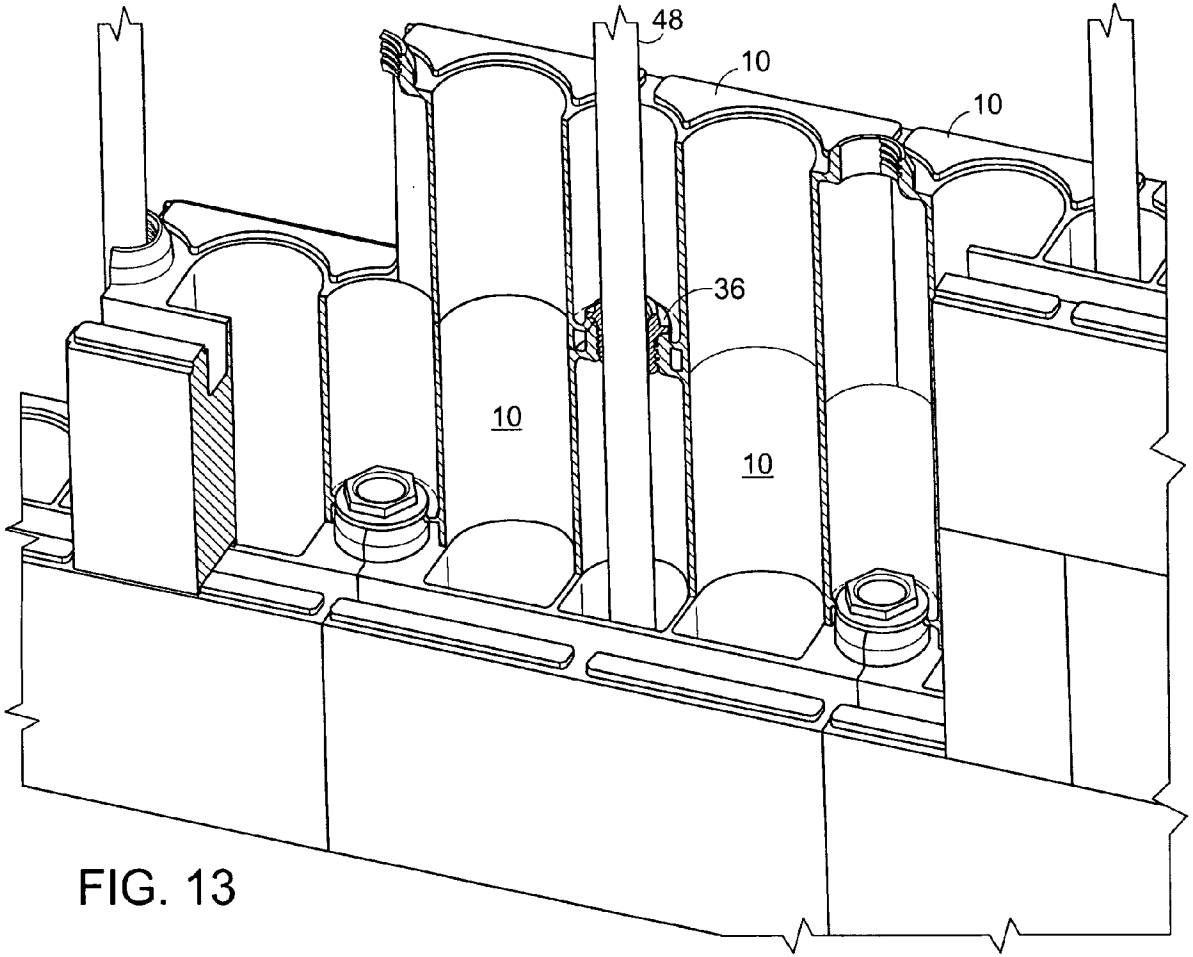
FIG. 13 is a partial cross-sectional view taken through the wall of FIG. 11.
Figure 14:
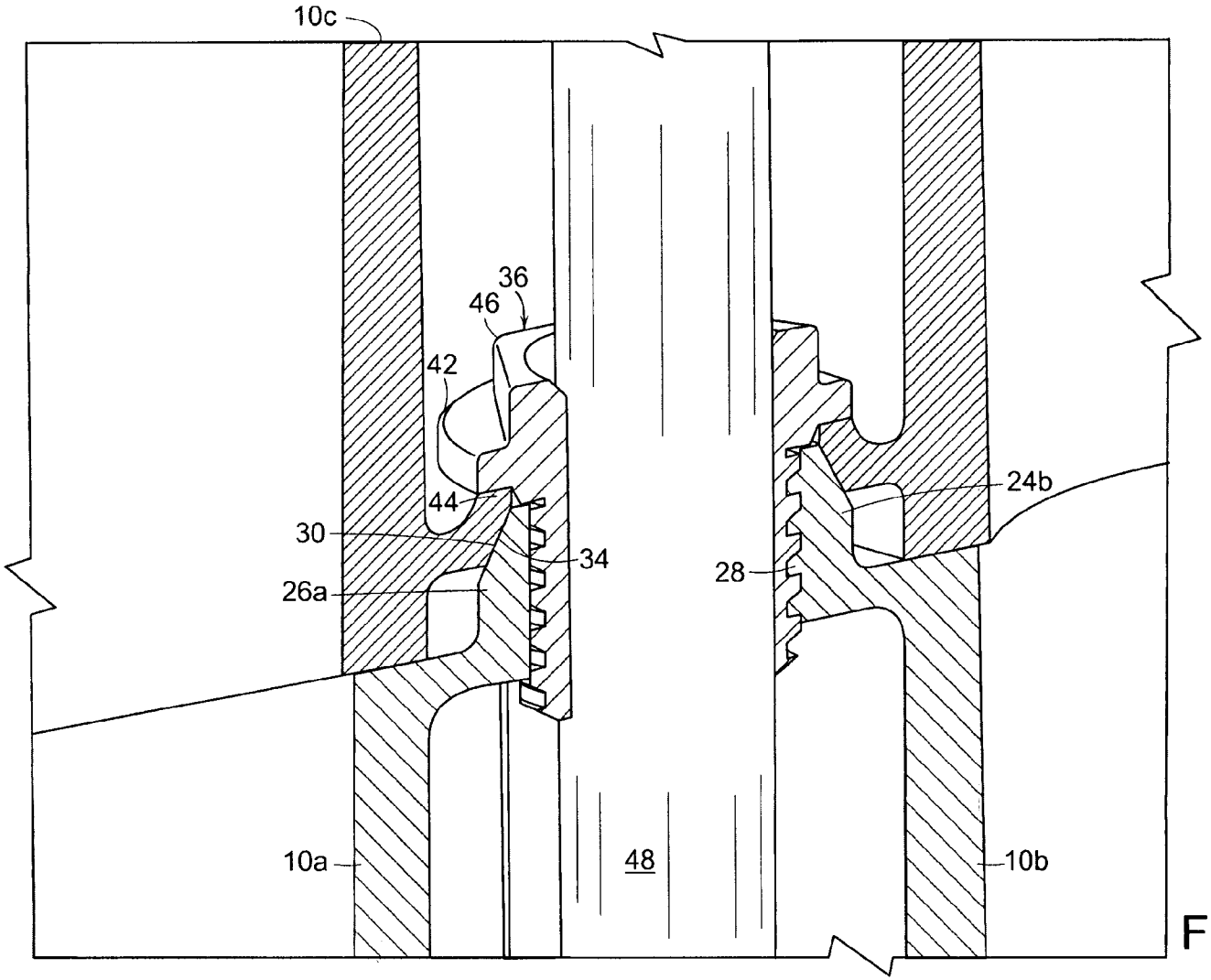
FIG. 14 is a cross-sectional view showing the connection of two adjacent blocks of a course in combination with a block of an upper course connected using the retainer member.

As may be best seen in FIGS. 12–14, adjacent blocks 10*a*, 10*b* are positioned such that their respective protruding portions 26*a*, 24*b*, are located adjacent each other to form a circular fastener which has a tapered edge 30 engaged with the tapered edge 34 of the aperture 32 of a block 10*c* located in a course of blocks 10 above the course containing the blocks 10*a*, 10*b*. A retainer member 36 (see also FIGS. 7–10) is provided through an opening 38 in the top of the block 10*c* and includes a double-helical thread 40 for threadably engaging the thread portion 28 of each of the protruding portions 26*a*, 24*b*.

In addition, the retainer member 36 includes a radially extending flange 42 for engaging a shoulder portion 44 surrounding the aperture 32. Engagement of the flange 42 with the shoulder 44 defines a lower position for the retainer member 36 as it threadably engages the cooperating protruding portions, 24, 26 and thereby draws the protruding portions 24, 26 into wedging engagement with the tapered surface 34. In this manner, two lower blocks 10 are positively locked in engagement with a block 10 of an upper course to thereby interlock all of the blocks of a wall in the modular building system. It should also be noted that the top of the retainer member includes a hexagonal portion 46 for facilitating rotation of the retainer member 36 by a specially designed tool (not shown) when it is located down inside the block 10.

The modular building system further includes a frame structure for carrying vertical loads of the wall. Specifically, tubular metal pipes 48 extend vertically through the courses of blocks 10 at the locations of the connections between adjacent blocks 10 formed by the retainer members 36. The retainer members 36 include an aperture 50 therethrough wherein the aperture 50 defines an inside diameter which is slightly greater than the outside diameter of the pipes 48. Accordingly, the inside diameter of the retainer members 36 and the outside diameter of the pipes 48 is sized such that there is a sliding fit between the retainer members 36 and the pipes 48 in order to avoid transfer of vertical loads between the vertical pipe 48 and the blocks 10 through which they pass.

In a further aspect of the construction of the modular building system, a horizontal pipe (not shown) is provided in the foundation of a building and includes upwardly extending stubs spaced a distance corresponding to the locations of the upwardly extending pipes 48. These stubs may be provided with a threaded portion for engaging a threaded portion of the vertical pipes 48 whereby the vertical pipes 48 may be rigidly connected to the foundation. In addition, the building construction further preferably includes horizontal header pipes for engaging the upper ends of the vertical pipes 48 whereby loads from upper portions of the building, such as roof loads, are transferred directly through the vertical pipes 48 to the foundation. In this manner, the vertical pipes 48 carry substantially all vertical compressive loads, as well as vertical tensile loads, such as may occur during high winds pulling upwardly on the roof of the building. Thus, the present invention advantageously provides a structural framework for carrying loads of the building and avoids the need for providing the blocks 10 themselves with a design for withstanding vertical loads of the building.

Figure 2:
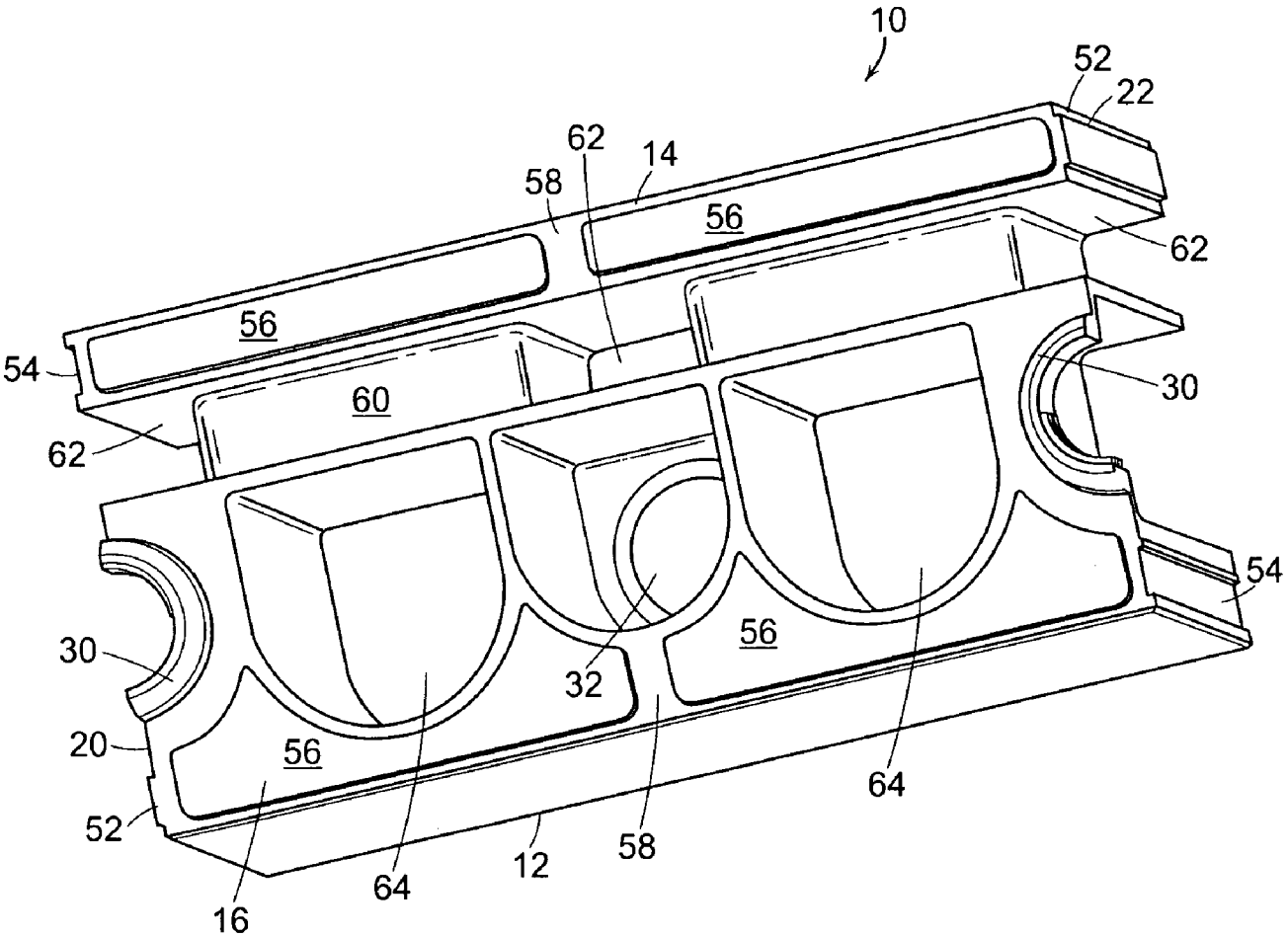
FIG. 2 is a top perspective view of the block of FIG. 1.
Figure 3:
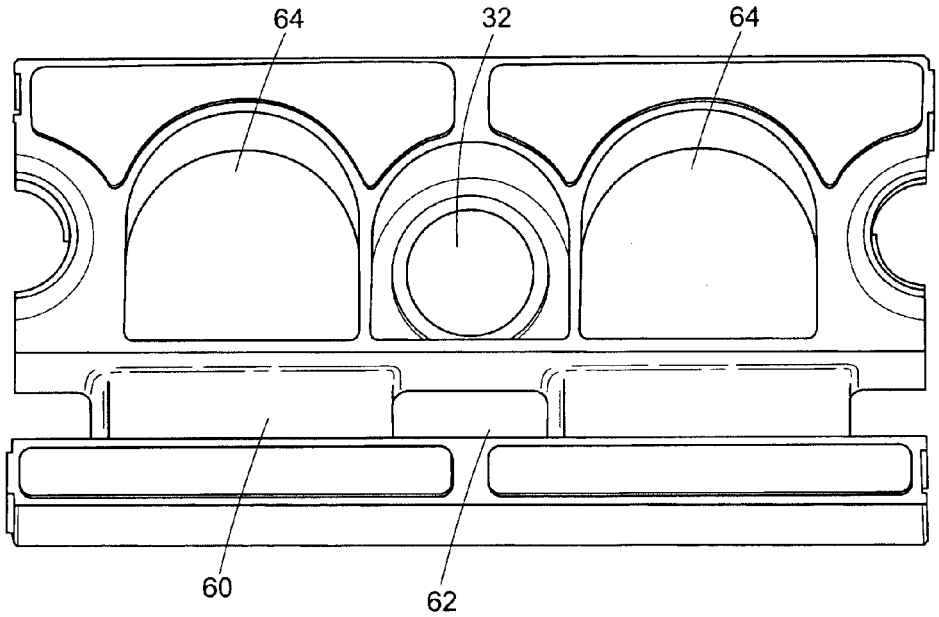
FIG. 3 is a top perspective view of the block of FIG. 1.
Figure 4:
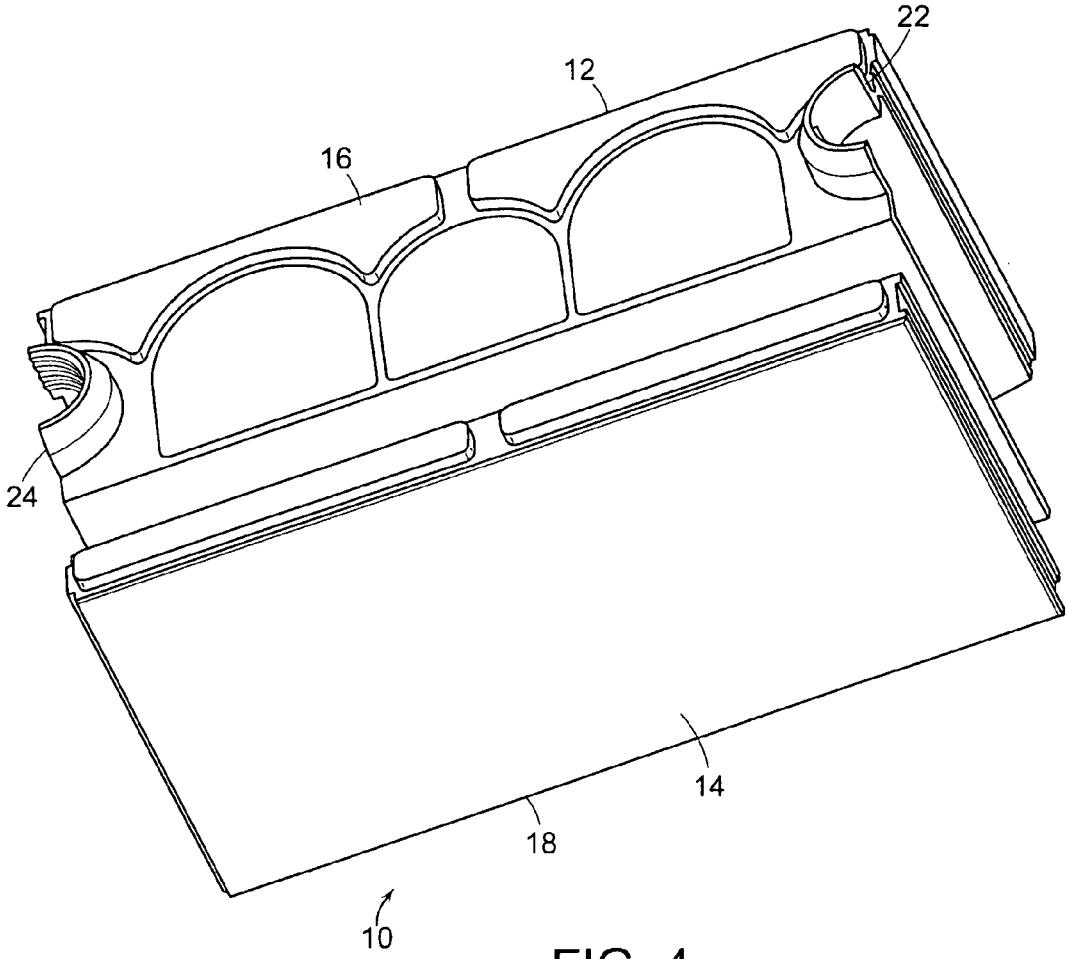
FIG. 4 is a top rear perspective view of the block of FIG. 1.

Referring to FIG. 2, it can be seen that the end portions 20, 22 are formed with tongue portions 52 and groove portions 54 wherein the tongue and groove portions 52, 54 of adjacent blocks 10 cooperatively engage with each other to form a sealed joint between blocks 10.

Similarly, the upper portion 16 of the block 10 is provided with raised portions 56 surrounded by recessed portions 58 and the lower edges of blocks of an upper course are configured to engage the recess areas 58 of an immediately lower course of blocks 10 around the raised portions 56 to thereby form a seal between courses of the blocks.

Figure 15:
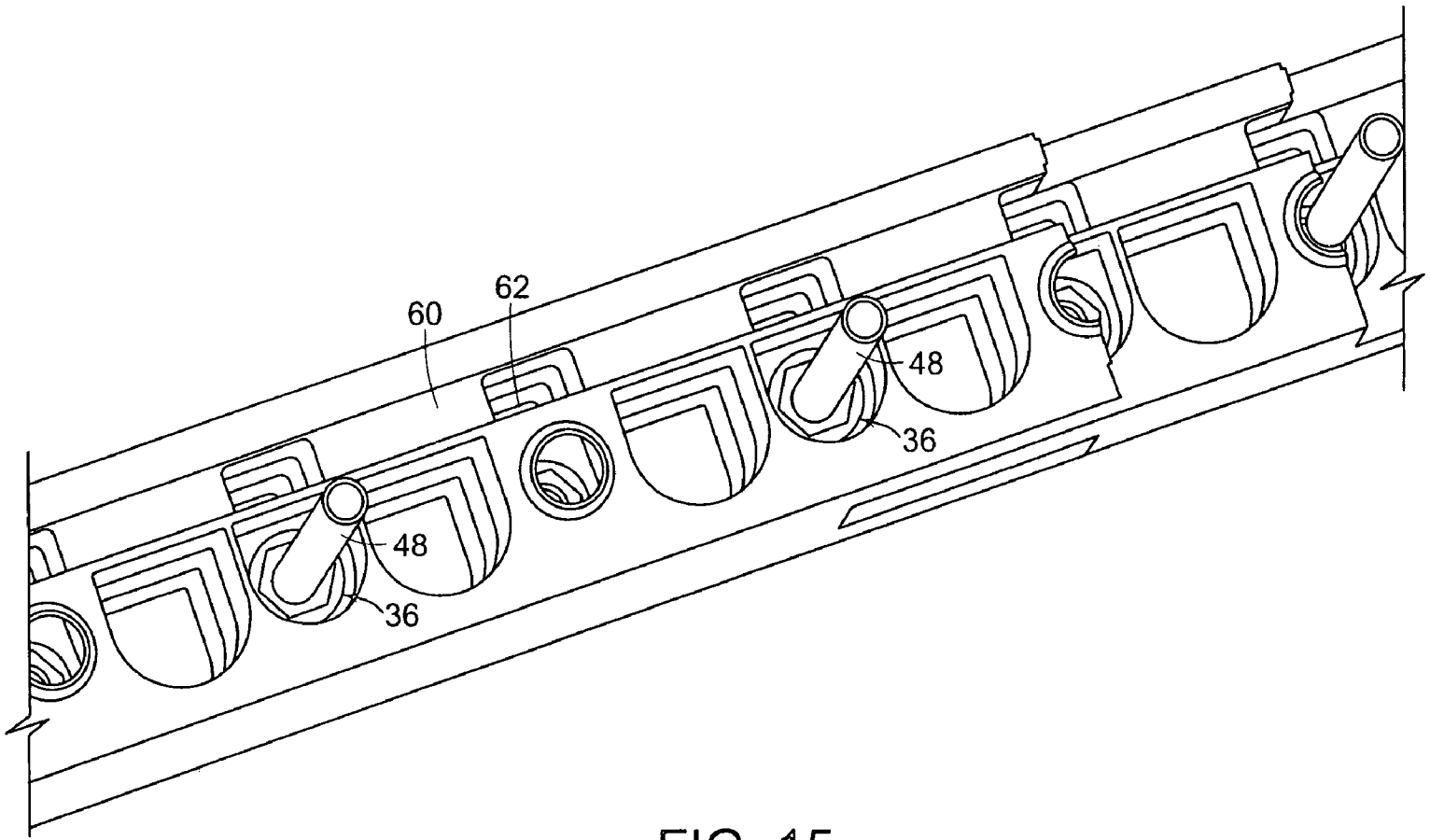
FIG. 15 is a top perspective view of the wall of FIG. 11.
Figure 16:
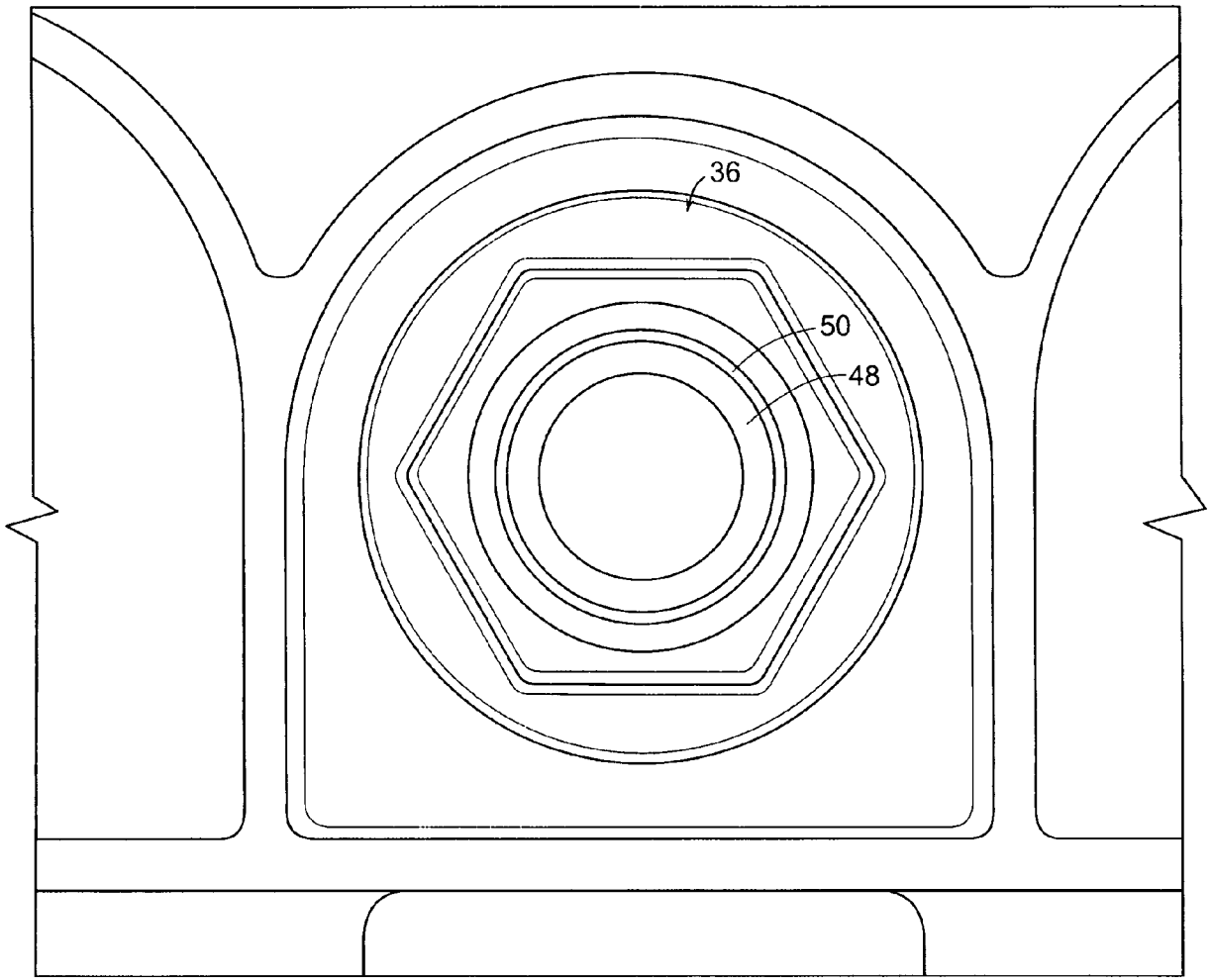
FIG. 16 is a top plan view of a section of a block containing the retainer member.
Figure 17:
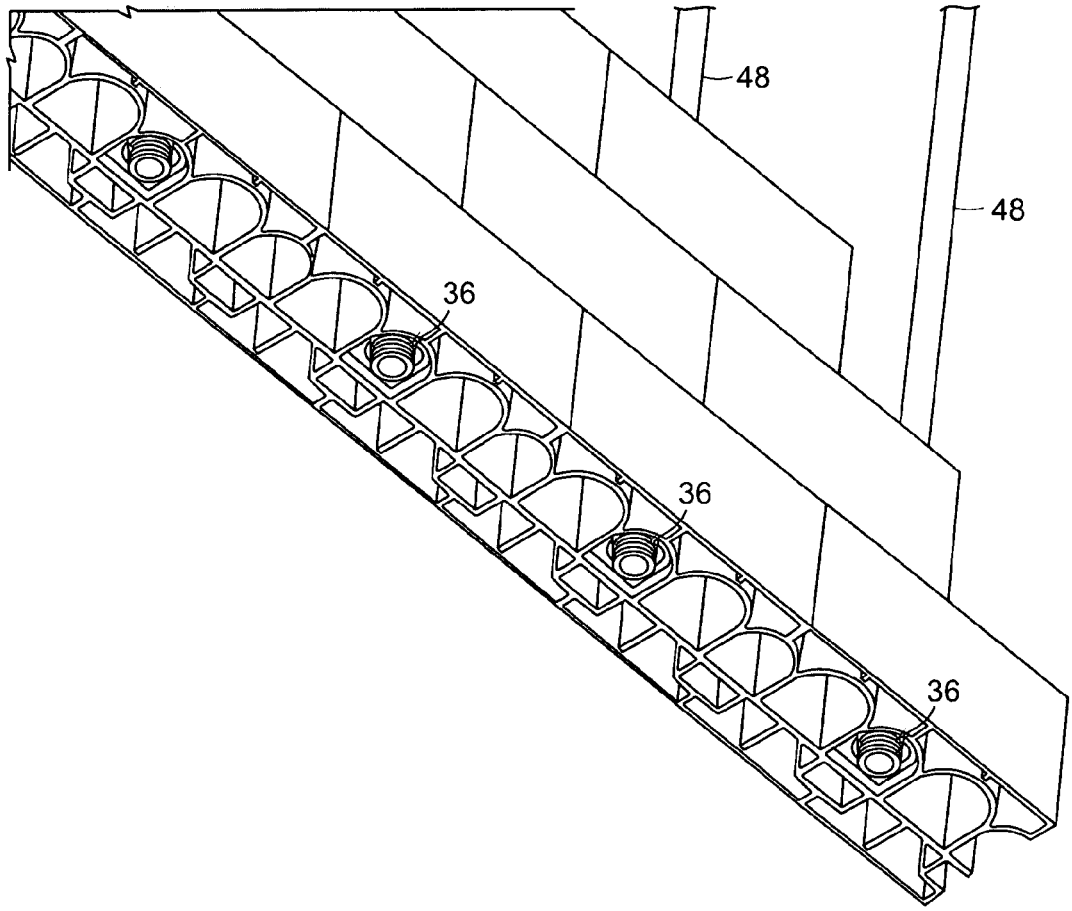
FIG. 17 is a bottom perspective view of the wall of FIG. 11.

The blocks 10 are further formed with horizontal passages 60 and vertical passages 62, as may be further seen in FIG. 15. The horizontal and vertical passages 60, 62 provide areas within the blocks for receiving electrical wires or piping, such as for water pipes, or for any other utility required to pass through the wall structure. Thus, access to utilities through the wall is provided along a plurality of vertical passages 62, as well a horizontal passage 60 being provided along each course of the blocks 10.

Additional passages 64 are also provided extending vertically through the blocks, which passages may be used for air flow through the wall, such as may be provided by either passive or forced air flow.

Figure 5:
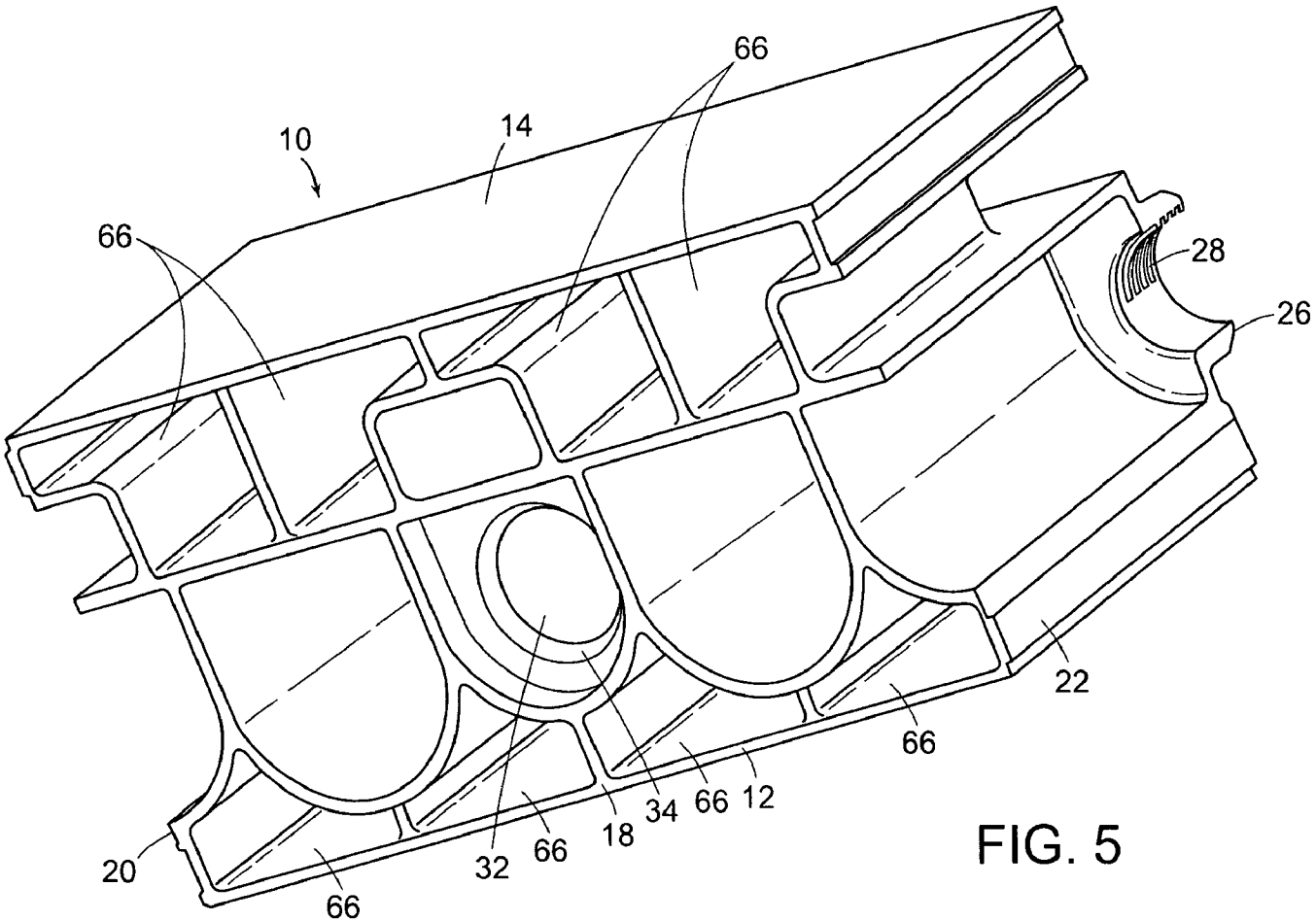
FIG. 5 is a bottom perspective view of the block of FIG. 1.
Figure 6A:
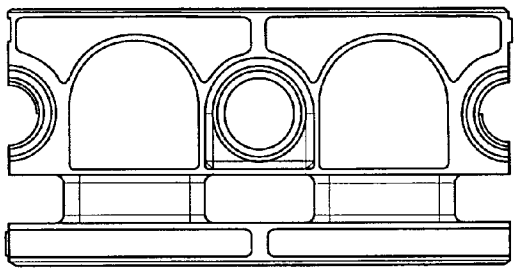
FIG. 6A is a top plan view of the block of FIG. 1.
Figure 6B:
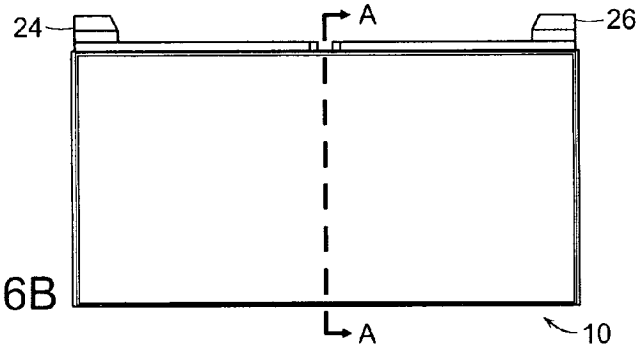
FIG. 6B is a side elevational view of the block of FIG. 1.
Figure 6C:
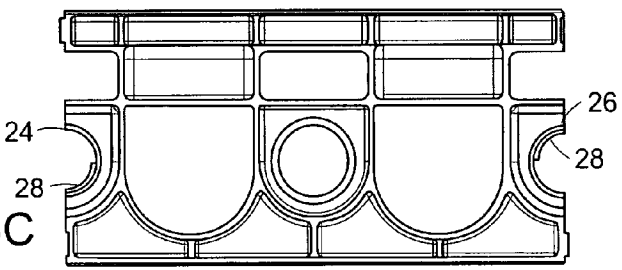
FIG. 6C is a bottom plan view of the block of FIG. 1.
Figure 6D:
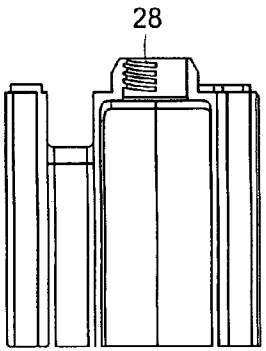
FIG. 6D is an end view of the block of FIG. 1.
Figure 6E:
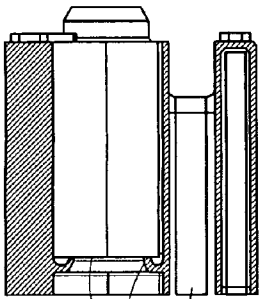
FIG. 6E is a cross-sectional view taken along line A—A in FIG. 6B.
Figure 7:
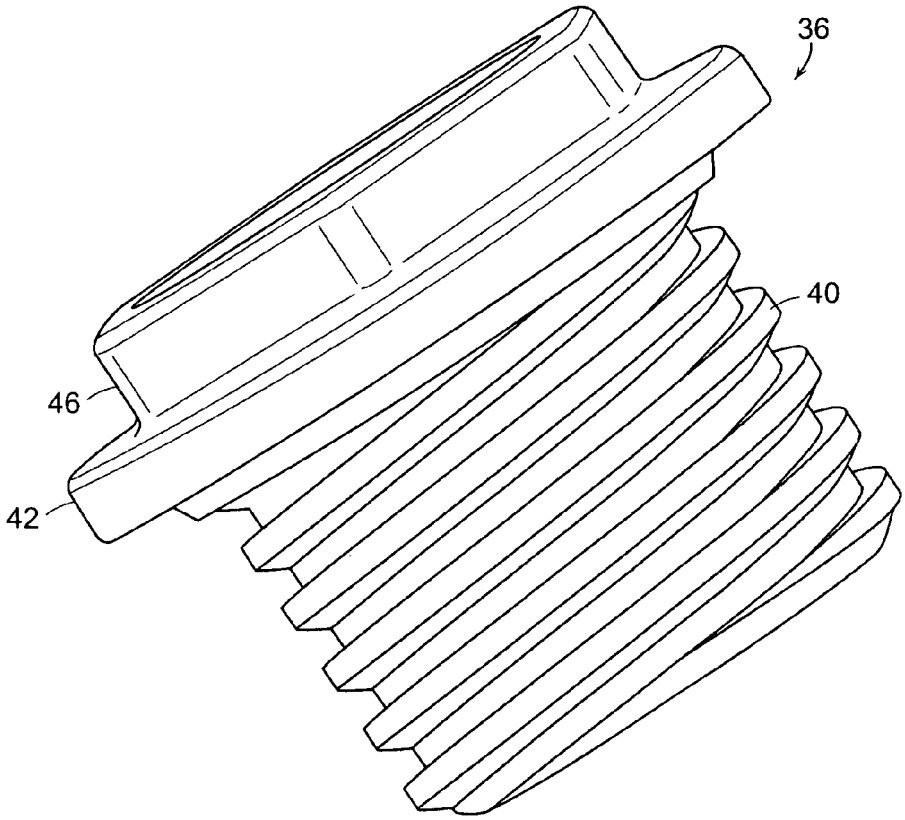
FIG. 7 is a side view of a retainer member for use with the block of FIG. 1.
Figure 8:
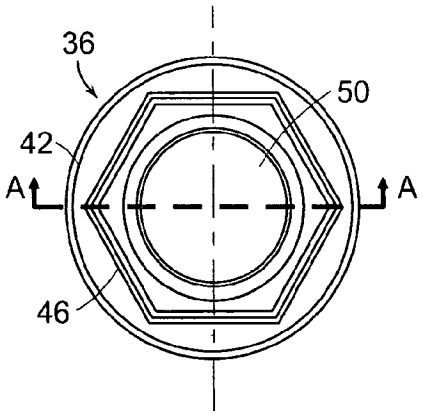
FIG. 8 is a top plan view of a retainer member of FIG. 7.
Figure 9:
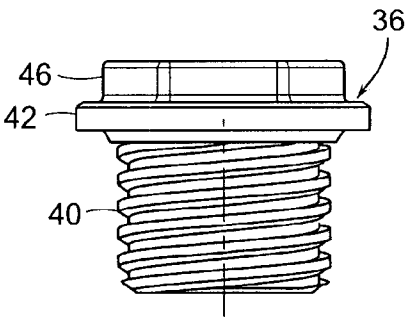
FIG. 9 is a side elevational view of the retainer of FIG. 7.
Figure 10:
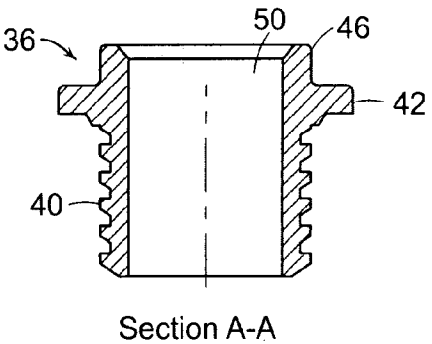
FIG. 10 is a cross-sectional view taken along line A—A in FIG. 8.
Figure 11:
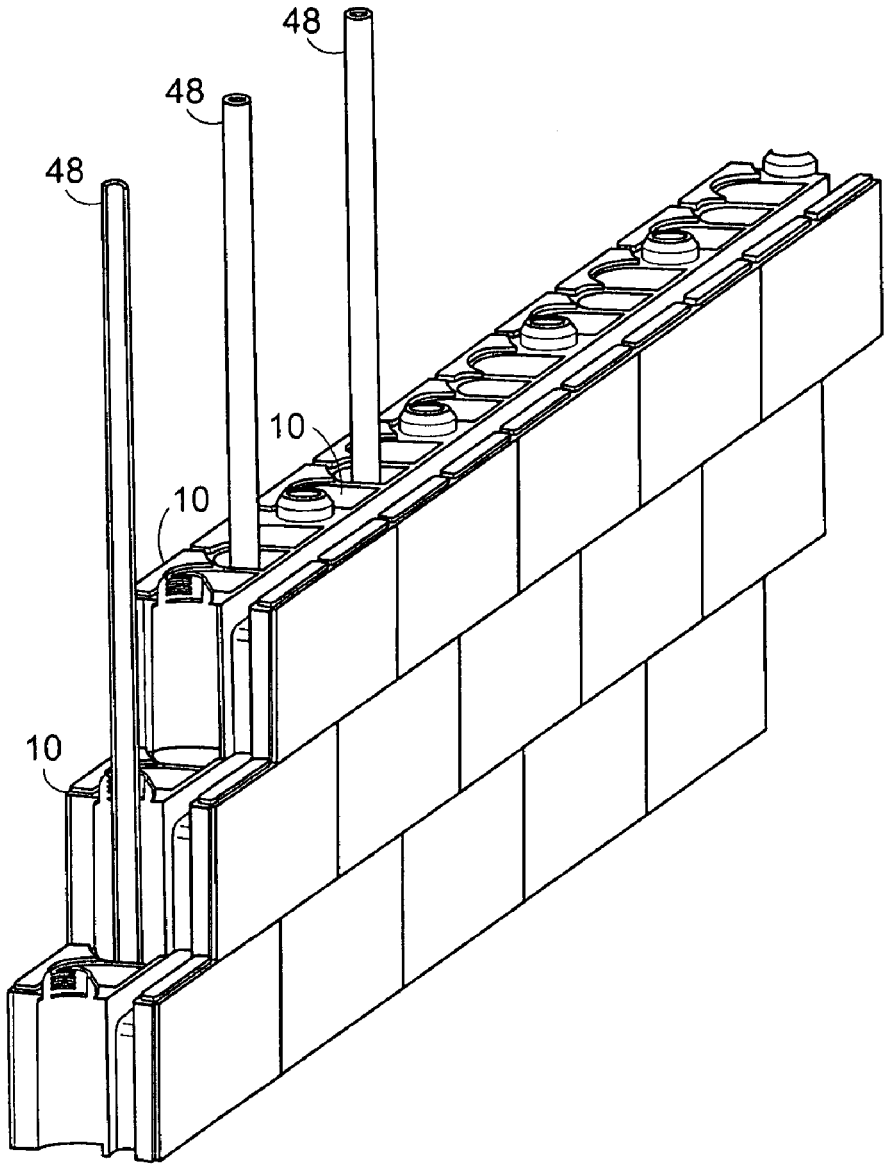
FIG. 11 is a section of a wall constructed using the modular block system incorporating blocks formed in accordance with FIG. 1.

Referring to FIG. 5, it should be noted that the block 10 is formed as a hollow molded member and includes cavities 66 open toward the bottom portion 18. These cavities 66 are preferably filled with an insulating material to thereby reduce heat flow between the opposing side walls 12 and 14.

Figure 18:
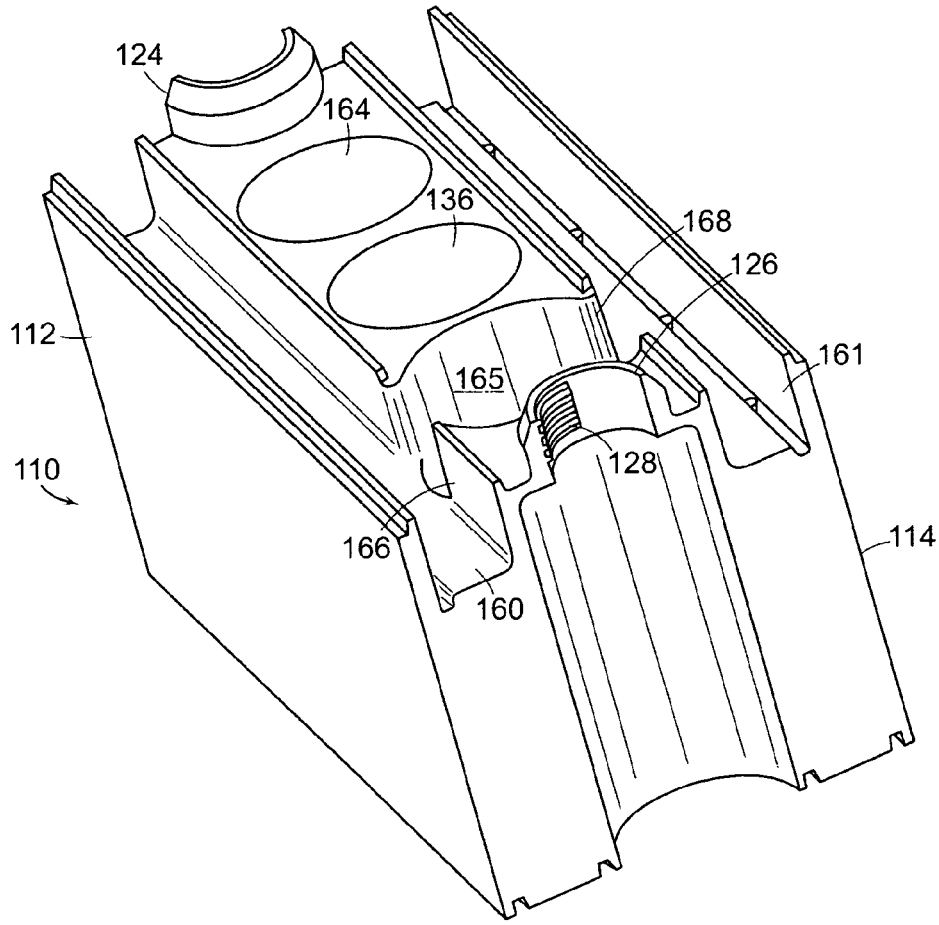
FIG. 18 is a perspective view of a second embodiment of a block for use in the modular block system.
Figure 19:
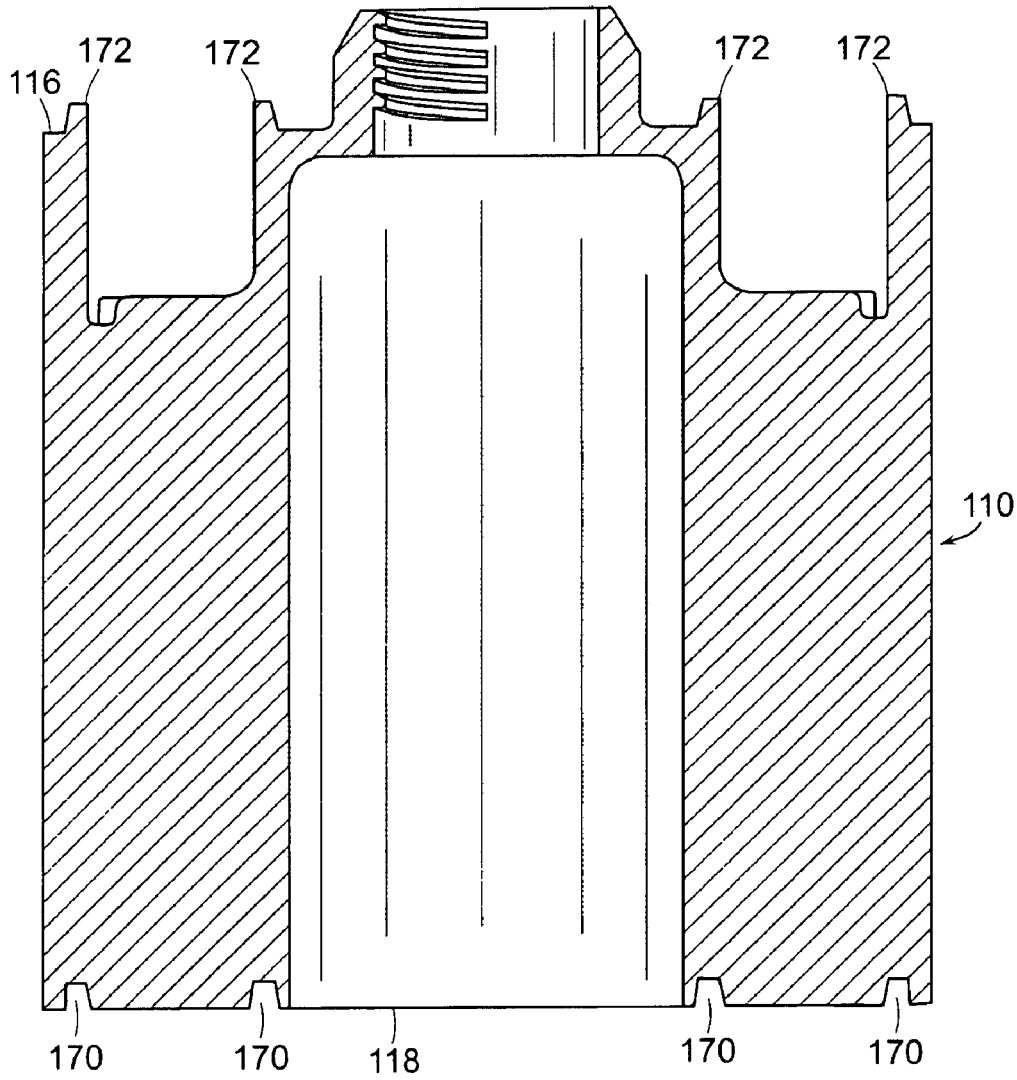
FIG. 19 is a side elevational view of the block of FIG. 18.
Figure 20:
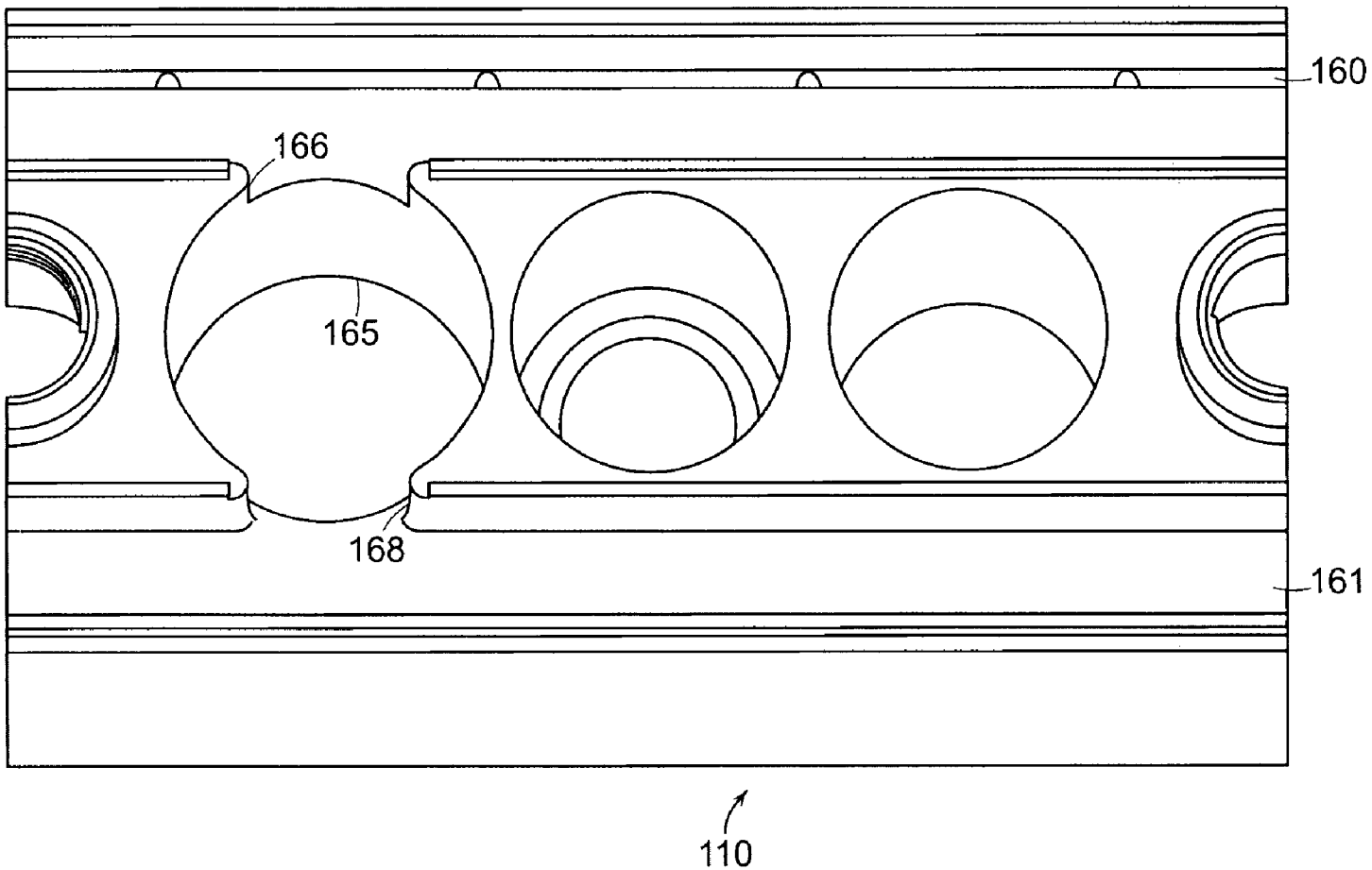
FIG. 20 is a further perspective view of the block of FIG. 18.

Referring to FIGS. 18–20, a second embodiment of the block is illustrated and is designated 110. Elements corresponding to elements in the first embodiment are designated with the same reference numeral increased by 100.

As with the blocks 10 of the first embodiment, the block 110 is provided with protruding portions 124, 126, including a thread portion 128. A wall structure constructed with the blocks 110 is held together in the same manner as described above with regard to the blocks 10 wherein a retainer member similar to the member 36 is engaged within the protruding portions 124, 126.

The block 110 includes a central opening 138 for accessing a retainer member when assembling the blocks 110 together, and further includes vertical through passages 164, 165 on either side of the central opening 138. The passage 165 includes open side portions 166, 168 opening into respective horizontal passages 160, 161. As in the previous embodiment, utilities may be conveyed through the horizontal passages 160, 161, as well as through the vertical passage 165, and the side openings 166,168 provide access from the vertical passage 165 to the horizontal passages 160, 161. In addition, these passages 165, 160, 161 may also provide for air flow through the blocks.

Sealing between different courses of the blocks 110 is provided by grooves 170 formed on the lower portion 118 of the block 110 and which are adapted to be engaged by tongue portions 172 formed along an upper portion 116 of the block 110.

In addition, it should be noted that equal cavity areas are provided on either side 112, 114 of the block 110 for receiving substantially equal thicknesses of insulation on either side of the block 110 to provide improved insulating characteristics of the block 110.

Figure 21:
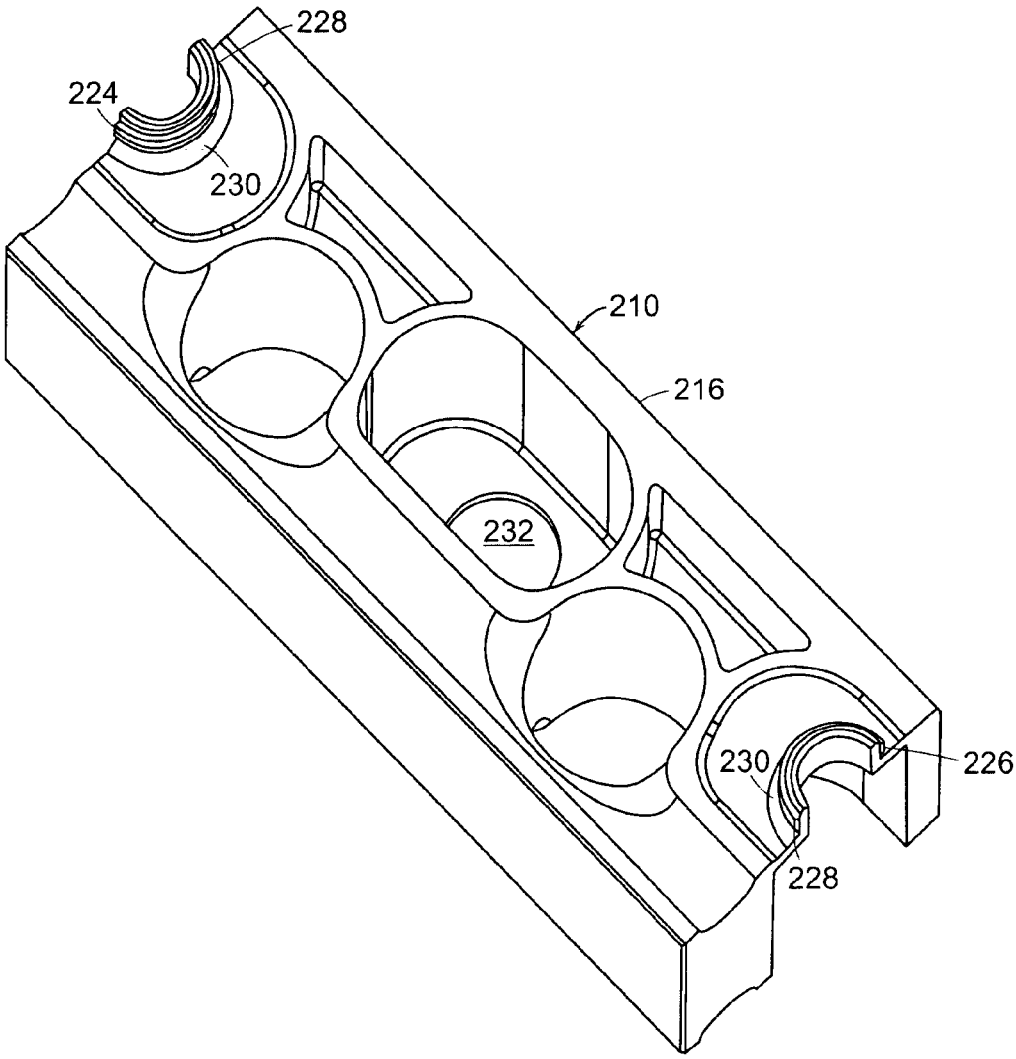
FIG. 21 is a top perspective view of a third embodiment of a block for use in the modular block system.
Figure 22:
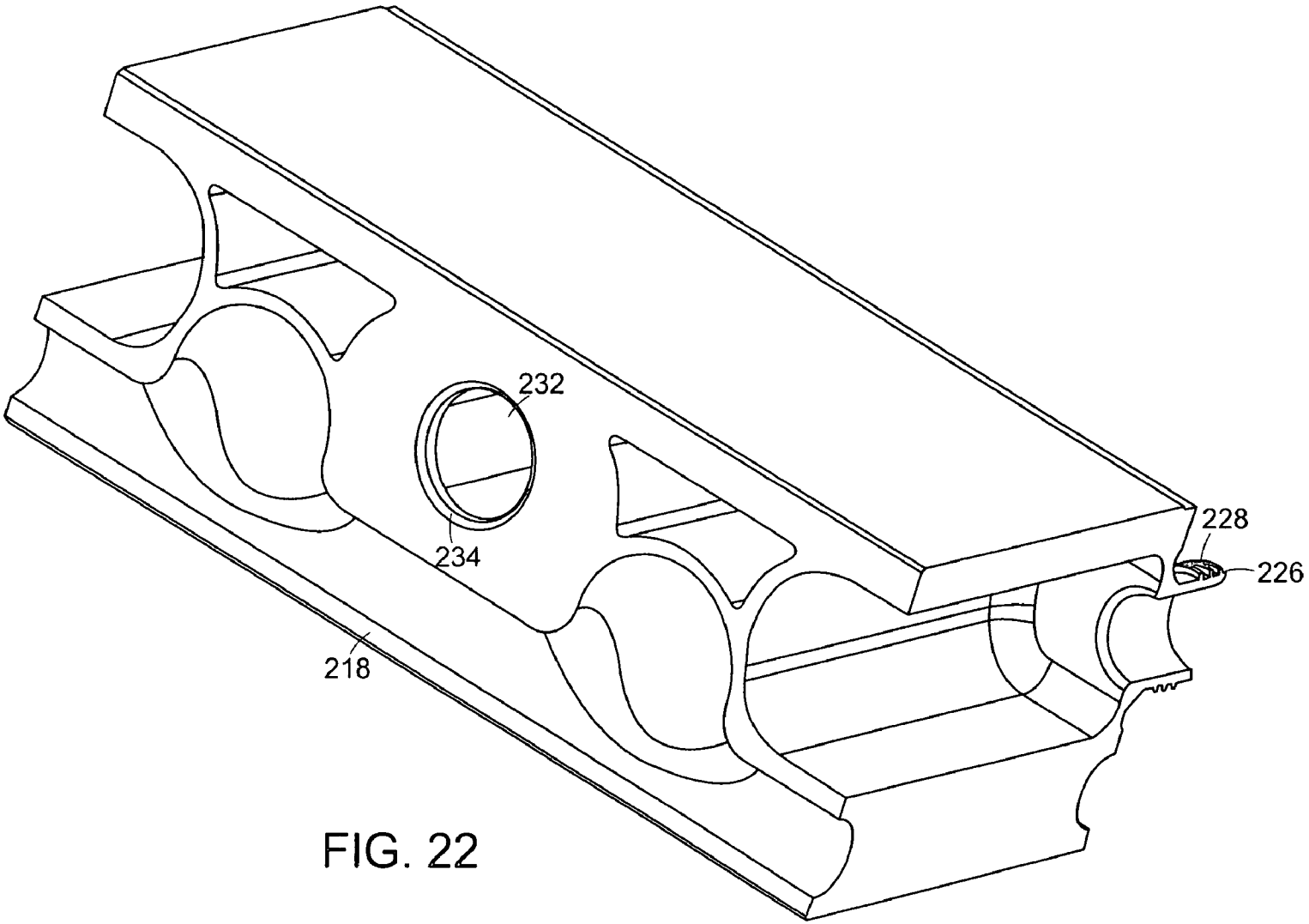
FIG. 22 is a bottom perspective view of the block of FIG. 21.

Referring to FIGS. 21 and 22, a third embodiment of the block is shown and is designated 210, and wherein elements corresponding to elements in the first embodiment are labeled with the same reference numeral increased by 200.

The block 210 is formed with protruding portions 224, 226, wherein each of the protruding portions includes a thread portion 228 located along the exterior convex surface of the protruding portions 224, 226. The protruding portions 224, 226 of adjacent blocks 210 form a circular fastener which is configured to extend upwardly through an aperture 232 formed in the lower portion 218 of an upper block 210.

Figure 23:
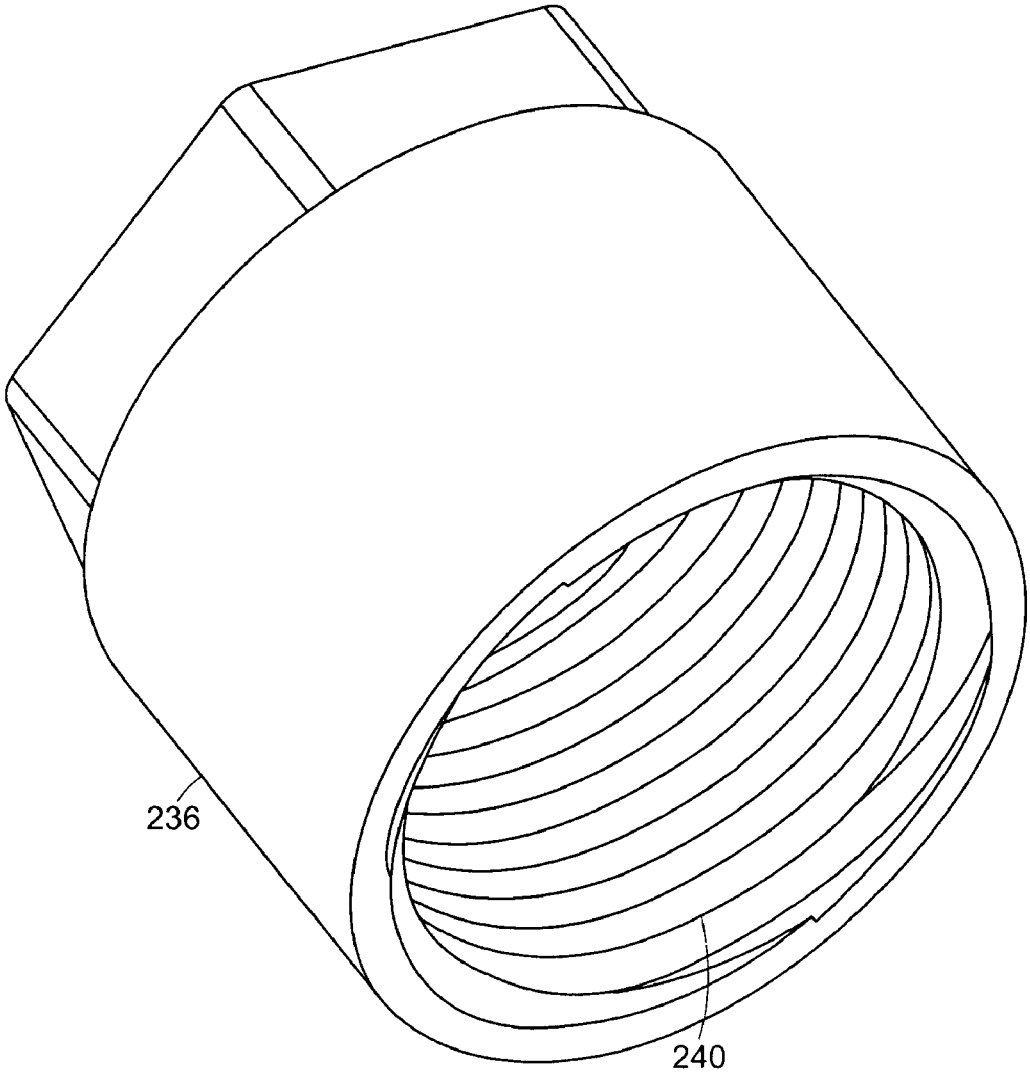
FIG. 23 is a bottom perspective view of a retainer member for use with the block of FIG. 21.

FIG. 23 illustrates a retainer member 236 having an internal double helical thread 240 for engaging over the threads 228. In an assembly of two lower blocks 210 to an upper block 210, the protruding portions 224, 226 of the two lower blocks 210 are positioned extending through the aperture 232 such that the thread portion 228 is positioned interiorly of the upper block 210 where the retainer member 236 is engaged with the thread 228. It should be noted that the lower portion of the protruding portions 224, 226 is formed with an angled shoulder 230 for engaging with an angled shoulder 234 surrounding the aperture 232. Further, it should be noted that the retainer member 236 is formed with a through hole for receiving a pipe member therethrough in sliding engagement, in a manner similar to that described for the first embodiment.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. A modular building system comprising:

at least one block having a pair of generally flat first and second walls;

a pair of end portions located at longitudinal ends of said first and second walls and extending between said first and second walls;

a generally planar upper portion extending between upper edges of said first and second walls;

a generally planar lower portion extending between lower edges of said first and second walls;

a protruding portion extending upwardly from said upper portion, said protruding portion comprising a section of a cylinder and including an engagement portion for engaging an engagement portion of a cooperating retainer member;

wherein said protruding portion is located adjacent one of said end portions and including a second protruding portion located adjacent the other of said end portions, said second protruding portion comprising a section of a cylinder and each of said protruding portions including an engagement portion comprising a thread portion for engaging an engagement portion comprising a thread of a cooperating retainer member.

2. The system of claim 1 wherein said protruding portion comprises a half cylinder defining a half fastener.

3. The system of claim 1 wherein said protruding portions each comprise half cylinders defining half fasteners.

4. The system of claim 3 wherein thread portion on each of said protruding portions extends approximately 45 degrees circumferentially around each of said half fasteners.

5. A modular block system comprising:

a plurality of blocks for positioning adjacent to one another to form courses and for stacking upon one another to form layers of courses;

said blocks comprising opposing first and second walls, opposing upper and lower portions extending between said first and second walls, and a pair of opposing end portions extending between said first and second walls and between said upper and lower portions;

said blocks including protruding portions extending upwardly from said upper portion and located adjacent said end portions, each said protruding portion formed as a half cylinder;

said lower portion of each said block including an aperture; and wherein the protruding portions of two adjacent blocks in a course are positioned to form a cylindrical fastener member and the cylindrical fastener member is located within the aperture of a block located above the two adjacent blocks.

6. The system of claim 5 wherein said protruding portions each include a thread portion, and including a threaded retainer member engaged with said thread portions of said two adjacent blocks, said threaded retainer including a head portion located within the block located above the two adjacent blocks.

7. The system of claim 5 including a frame structure including vertical frame members extending through the cylindrical fastener members.

8. The system of claim 7 wherein the frame members carry vertical loads of the system and are in sliding engagement through the cylindrical fastener members to avoid transferring vertical loads to the blocks.

9. The system of claim 8 wherein the vertical frame members comprise tubular pipes.

10. A modular building system comprising:

at least one block having a pair of generally planar first and second walls;

a pair of end portions located at longitudinal ends of said first and second walls and extending between said first and second walls;

a generally planar upper portion extending between upper edges of said first and second walls;

a generally planar lower portion extending between lower edges of said first and second walls;

a protruding portion extending upwardly from said upper portion, said protruding portion comprising a section of a cylinder and including an engagement portion for engaging an engagement portion of a cooperating retainer member;

wherein said protruding portion is located adjacent one of said end portions and including a second protruding portion located adjacent the other of said end portions, said second protruding portion comprising a section of a cylinder and each of said protruding portions including an engagement portion comprising a thread portion for engaging an engagement portion comprising a thread of a cooperating retainer member.

11. The system of claim 10 wherein said protruding portion comprises a half cylinder defining a half fastener.

12. The system of claim 10 wherein said protruding portions each comprise half cylinders defining half fasteners.

13. The system of claim 12 wherein thread portion on each of said protruding portions extends approximately 45 degrees circumferentially around each of said half fasteners.

* * * * *